US005813126A

United States Patent [19]

Dahl

[11] Patent Number: 5,813,126

[45] Date of Patent: Sep. 29, 1998

[54] SPEED SQUARE EXTENSION BAR AND SAW GUIDE

[75] Inventor: Curtis Edward Dahl, Eagle River, Ak.

[73] Assignee: Toni Rae Fisher, Kenai, Ak.; a part interest

[21] Appl. No.: 845,606

[22] Filed: Apr. 25, 1997

[51] Int. Cl.[6] ..... B43L 7/027

[52] U.S. Cl. ..... 33/474; 33/42; 33/427

[58] Field of Search ..... 33/42, 418, 419, 33/420, 427, 429, 430, 433, 437, 464, 468, 474, 479, 480, 484; 83/745

[56] References Cited

U.S. PATENT DOCUMENTS

| | | | |
|---|---|---|---|
| 208,104 | 9/1878 | Kurtz | 33/427 |
| 1,101,119 | 6/1914 | Classon | 33/474 |
| 3,093,096 | 6/1963 | Cohara | 33/430 |
| 3,296,702 | 1/1967 | Feddish | 33/427 |
| 3,390,461 | 7/1968 | Anderson | 33/464 |
| 3,488,868 | 1/1970 | Gutowski et al. | 33/464 |
| 3,979,987 | 9/1976 | Mayhew et al. | 83/745 |
| 4,404,753 | 9/1983 | Klok | 33/474 |
| 4,573,276 | 3/1986 | Torczon | 33/481 |
| 4,641,435 | 2/1987 | Brown | 33/427 |
| 4,736,523 | 4/1988 | Hanning | 33/42 |
| 4,776,250 | 10/1988 | Julius | 33/480 |
| 4,967,482 | 11/1990 | Hoover et al. | 33/484 |
| 5,062,213 | 11/1991 | Kolesky | 33/464 |
| 5,170,568 | 12/1992 | Wright | 33/474 |
| 5,535,523 | 7/1996 | Endris | 33/474 |

FOREIGN PATENT DOCUMENTS

| | | | |
|---|---|---|---|
| 2660230 | 10/1991 | France | 33/427 |
| 110506 | 7/1924 | Switzerland . | |

*Primary Examiner*—G. Bradley Bennett

*Attorney, Agent, or Firm*—Christensen, O'Connor, Johnson & Kindness PLLC

[57] ABSTRACT

A channel extending longitudinally through an extension bar snugly but slidably receives the base flange of a speed square. The extension bar can be locked in a desired position relative to the square, and has mechanism for mounting a stop peg at a desired position along the length of the bar. The position of the square relative to a board to be marked or cut is set by engaging the stop peg against the end of the board while the extension bar is held flush against a longitudinal edge of the board. Each of several different boards can be marked at a predetermined desired length and/or an edge of the speed square can be used as a guide fence for a portable power saw.

6 Claims, 3 Drawing Sheets

SPEED SQUARE EXTENSION BAR AND SAW GUIDE

FIELD OF THE INVENTION

The present invention relates to an attachment for a speed square to simplify uniform markings and saw cuts on lumber.

BACKGROUND OF THE INVENTION

U.S. Pat. No. 5,170,568 issued to Wright shows a speed square of the type with which the present invention can be used. The Wright square includes a flat triangular plate. A flange projects oppositely from the flat sides of the plate along a base edge of the triangle. In use, the plate is placed flat against a broad surface of a board, and the flange typically is engaged against a longitudinal edge of the board. The square is manually held in position while the board is marked for cutting.

Other types of carpenter squares and marking tools are shown in Swiss patent No. 110506 and in the following U.S. patents:

Kurtz U.S. Pat. No. 108,104

Klok U.S. Pat. No. 4,404,753

Torczon U.S. Pat. No. 4,573,276

Brown U.S. Pat. No. 4,641,435

The following patents show different types of tools for providing guides, fences or gauges for power saws:

Anderson U.S. Pat. No. 3,390,461

Hanning U.S. Pat. No. 4,736,523

SUMMARY OF THE INVENTION

The present invention provides an adjustable extension bar having a channel sized to snugly but slidably receive the base flange of a speed square. The extension bar can be locked in a desired position relative to the square, and has mechanism for mounting a stop peg at a desired position along the length of the bar. The position of the square relative to a board to be marked or cut is set by engaging the stop peg against the end of the board while the extension bar is held flush against a longitudinal edge of the board. Each of several different boards can be marked at a predetermined desired length and/or an edge of the speed square can be used as a guide fence for a portable power saw.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
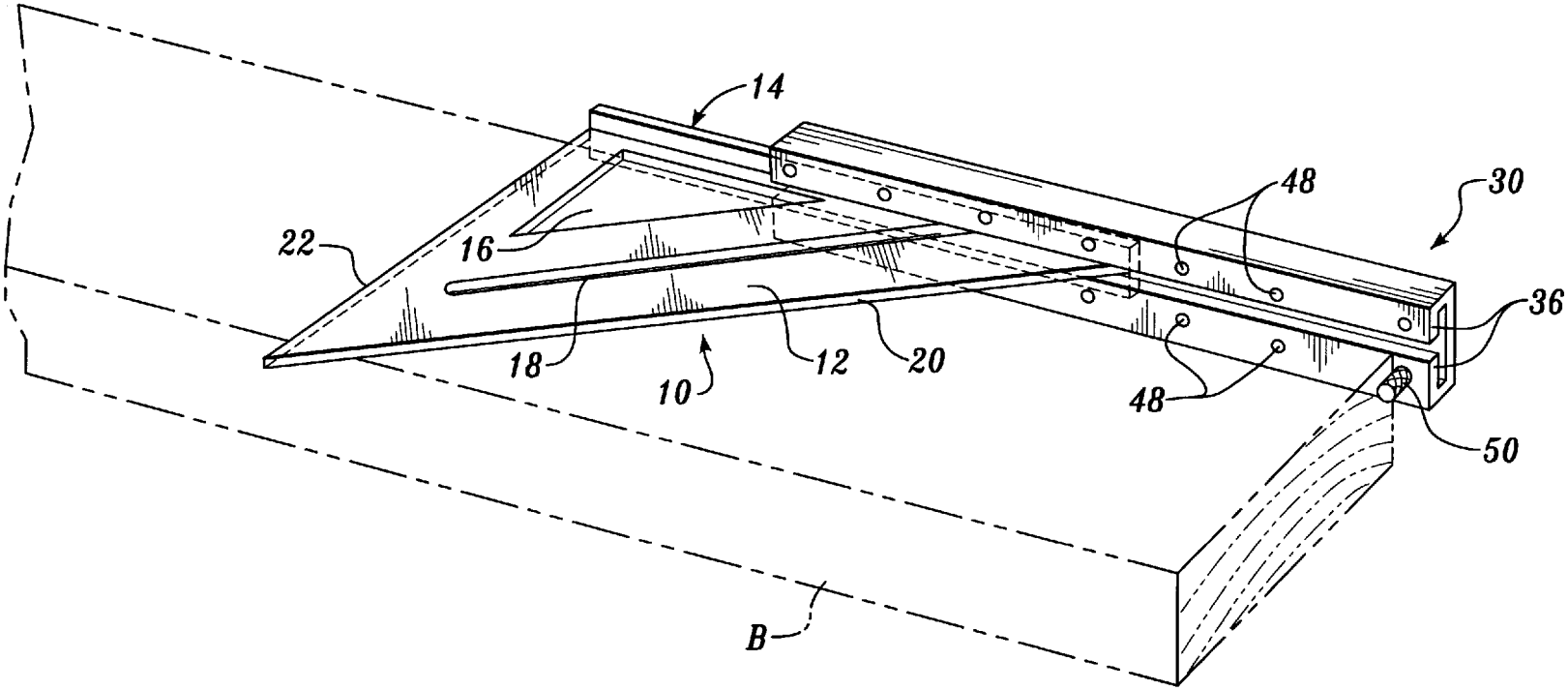
FIG. 1 is a top front perspective of a speed square and an extension bar in accordance with the present invention.

The speed square 10 shown in the drawings consists of a right triangular plate 12 and an integral side flange 14 extending along a base edge of the triangle. The flange includes top and bottom portions projecting oppositely from the top and bottom faces of the triangular plate 12. The plate may have a triangular opening 16 and a long diagonal slot 18 parallel to the hypotenuse edge 20. Calibration markings (not shown) of the general type shown in U.S. Pat. No. 5,170,568 can be included to adapt the speed square for marking various cuts on boards. As pertinent to the present invention, however, the speed square is typically used by engaging the flange 14 flush against a longitudinal edge of a board B to be marked. The square is held manually while a perpendicular mark is drawn or etched along the unflanged edge 22 of the square, or a 45° mark is drawn or etched along the hypotenuse edge 20. The square can be used with either its top or bottom face flat against a broad surface of the board.

Figure 3:
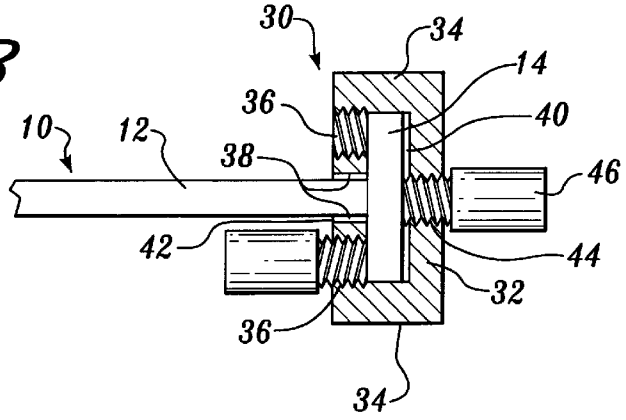
FIG. 3 is a transverse section of the speed square and extension attachment of FIGS. 1 and 2.

In accordance with the present invention, an extension bar 30 is adjustable along the length of the speed square flange 14. As seen in FIG. 3, the extension bar is of generally rectangular cross section, including a long flat web 32 and top and bottom flanges 34 projecting in the same direction and having inturned coplanar fingers 36. The inner ends 38 of the fingers 36 are spaced apart a distance slightly greater than the thickness of the speed square plate 12, and the inside surfaces of the fingers 36 are spaced from the inside surface of the web 32 a distance slightly greater than the thickness of the speed square flange 14. Thus, the flange is snugly but slidably received in the resulting open-ended channel 40 of the extension bar, with the base of the plate 12 received in the groove 42 between the inner ends 38 of the fingers 36.

Figure 2:
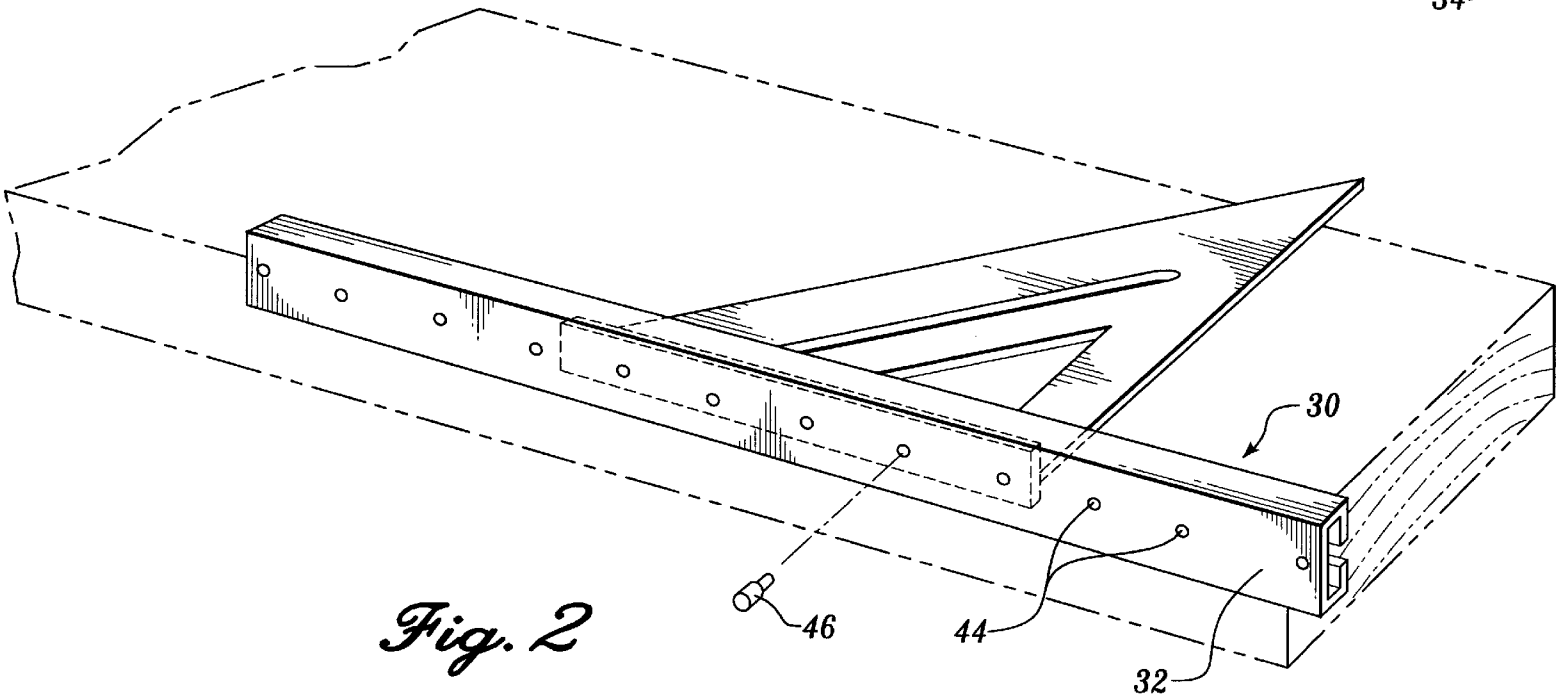
FIG. 2 is a top rear perspective thereof.

As best seen in FIG. 2, a row of threaded holes 41 is provided through the web 32 of the extension bar 30. A thumbscrew 46 can be threaded in a selected hole to clamp the speed square in a desired position relative to the extension attachment.

As seen in FIG. 1, each of the top and bottom fingers 36 has a longitudinally extending row of threaded holes 48. Each hole 48 is adapted to receive a threaded stop peg 50. Preferably the holes are spaced apart a uniform distance, such as one inch, so that the stop peg can be positioned along the length of either finger 36 at uniform increments.

One use for the extension bar in accordance with the present invention is for marking a number of boards for cutting of uniform lengths. With reference to FIG. 1, the stop peg 50 is positioned in a desired hole, such as at the end of the extension bar. The speed square is adjusted lengthwise of the bar until the desired distance from the stop peg to the marking edge of the speed square is achieved. The square then is locked in position by use of the back thumbscrew 46. The combined unit then is manually held in position while a line is marked on a board, and additional boards can be conveniently marked without separate measuring being required.

Figure 4:
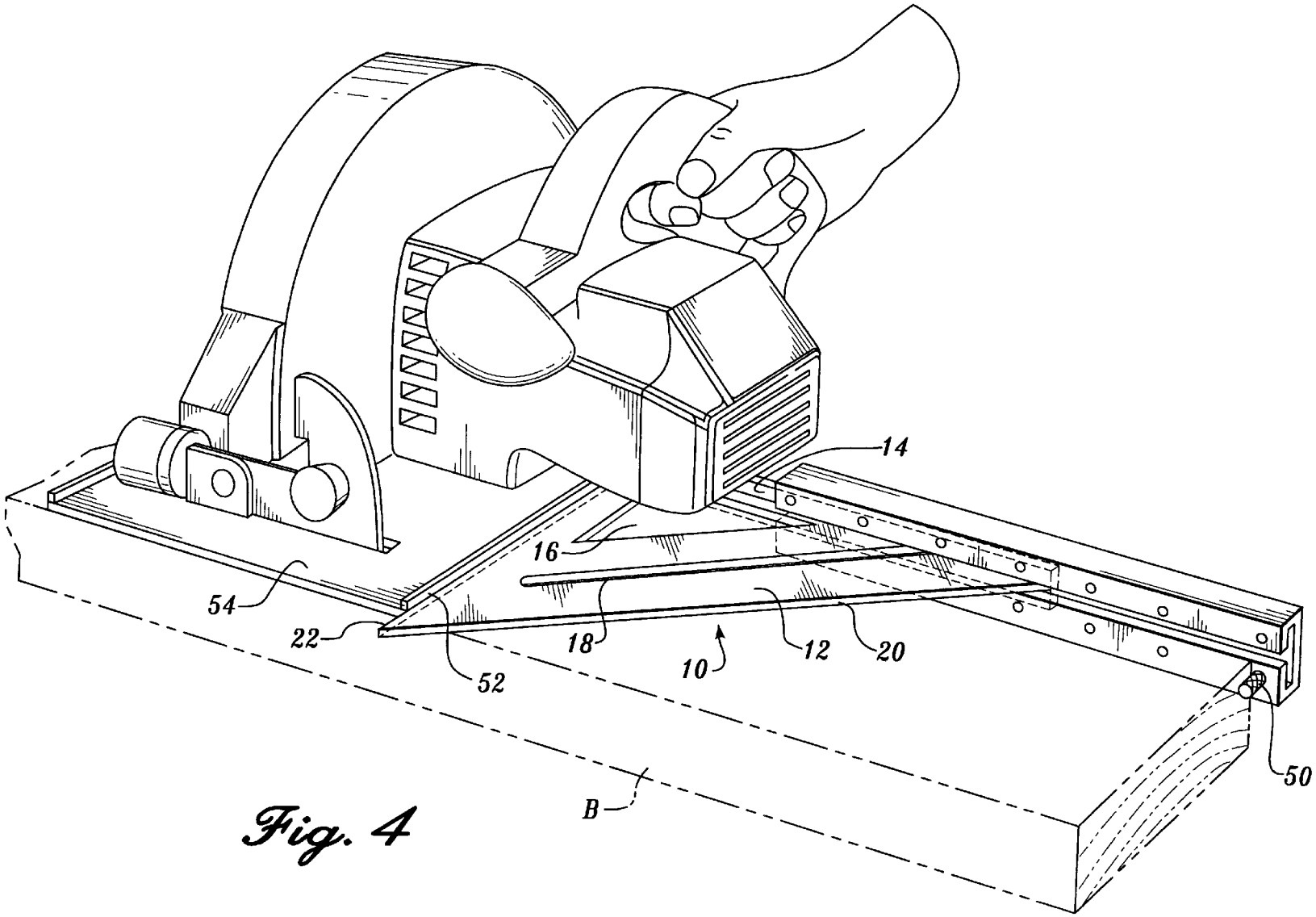
FIG. 4 is a top front perspective corresponding to FIG. 1, but illustrating use of a speed square and an extension bar in accordance with the present invention to provide a guide fence for a portable power saw.

Another use for the extension bar in accordance with the present invention is for reliably holding the speed square in a position appropriate that its marking edge acts as a guide fence for a portable power saw. FIG. 4 shows such an arrangement, with the stop peg 50 abutting the end of a board B to be cut, and the speed square 10 positioned so that its perpendicular marking edge 22 is a predetermined distance from the stop peg. A truly perpendicular and straight cut is achieved at the desired location on the board, provided that accommodation is made for the offset between the adjacent edge 52 of the power saw base plate 54 and the saw blade. Identical lengths can be cut from the same board or other boards without new measurements being made.

Extensions bars in accordance with the present invention preferably are made of a rigid, light and tough material, such as aluminum alloy or a hard plastic. Bars of different lengths can be provided depending on the intended use. For example, it is currently envisioned that the length of the bar could be between about 20 inches and three or four feet, or more.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An extension attachment for a speed square having a flat plate including one or more unflanged marking edges and a base flange extending along a side of the plate, said extension attachment comprising an elongated bar having a longitudinally extending channel of a cross section slightly greater than the cross section of the flange, said bar having a groove in a side thereof which groove opens into said channel such that the square is slidable in the channel with a base portion of the plate adjacent to the flange received in the groove, means for locking and unlocking the bar relative to the square, and a stop projecting from the grooved side of the bar.

2. The attachment defined in claim 1, in which the stop is a stop peg adapted to be secured adjacent to the groove at any one of a plurality of different positions along the length of the bar.

3. The attachment defined in claim 2, in which the stop is adapted to be secured at any one of a plurality of different positions along the length of the bar at either side of the groove.

4. The attachment defined in claim 1, in which the stop means includes a threaded member and a complementary threaded locking hole through the bar such that by screwing the threaded member in the hole the bar is clamped to the speed square flange.

5. The attachment defined in claim 4, in which the bar has a longitudinally extending row of spaced locking holes for the threaded member.

6. The attachment defined in claim 5, in which the locking holes extend through the side of the bar opposite the grooved side.

* * * * *